US009454922B1

(12) United States Patent
Norris

(10) Patent No.: US 9,454,922 B1
(45) Date of Patent: Sep. 27, 2016

(54) CAR WINDOW VISOR FLAG STICK

(71) Applicant: Christopher Edwin Norris, Simpsonville, SC (US)

(72) Inventor: Christopher Edwin Norris, Simpsonville, SC (US)

( * ) Notice: Subject to any disclaimer, the term of this patent is extended or adjusted under 35 U.S.C. 154(b) by 134 days.

(21) Appl. No.: 14/521,565

(22) Filed: Oct. 23, 2014

Related U.S. Application Data

(60) Provisional application No. 61/961,804, filed on Oct. 24, 2013.

(51) Int. Cl.
*G09F 17/00* (2006.01)

(52) U.S. Cl.
CPC ..... *G09F 17/00* (2013.01); *G09F 2017/0075* (2013.01)

(58) Field of Classification Search
CPC ..... G09F 17/00; G09F 17/0091; G09F 2017/0041; G09F 2017/0075; G09F 21/04; G09F 21/046; B60R 13/00; B60R 13/005; B60R 13/10
USPC ..... 116/28 R, 173, 174, 175; 40/591, 592; D11/182
See application file for complete search history.

(56) References Cited

U.S. PATENT DOCUMENTS

| | | | | |
|---|---|---|---|---|
| 3,715,821 | A | 2/1973 | Hawes | |
| 4,650,147 | A | 3/1987 | Griffin | |
| 4,986,209 | A | 1/1991 | Spica | |
| 5,226,792 | A | 7/1993 | Darago | |
| 5,233,938 | A | 8/1993 | Lalo | |
| D476,915 | S | 7/2003 | Blalock | |
| 7,878,139 | B1 * | 2/2011 | Karnes | G09F 17/00 116/173 |
| 8,613,258 | B1 | 12/2013 | Barry, IV et al. | |
| 2003/0019998 | A1 * | 1/2003 | Kou | B62J 11/00 248/534 |
| 2003/0084835 | A1 * | 5/2003 | Chao | G09F 17/00 116/173 |
| 2005/0263060 | A1 * | 12/2005 | Armstrong | B60R 13/00 116/28 R |

FOREIGN PATENT DOCUMENTS

| | | | | |
|---|---|---|---|---|
| CN | 201017584 Y | * | 2/2008 | G09F 17/00 |
| CN | 201158345 Y | * | 12/2008 | B60R 13/00 |
| DE | 29616507 U1 | * | 5/1997 | B60R 13/005 |
| DE | 29704224 U1 | * | 5/1997 | B60R 13/005 |
| DE | 29722461 U1 | * | 3/1998 | B60Q 1/50 |
| DE | 29722733 U1 | * | 6/1998 | B60Q 1/50 |
| DE | 102004003991 | * | 8/2004 | B60R 13/005 |
| GB | 2377681 A | * | 1/2003 | B60R 11/00 |

* cited by examiner

*Primary Examiner* — Richard A Smith
(74) *Attorney, Agent, or Firm* — J. Bennett Mullinax, LLC

(57) ABSTRACT

A car flag support which attaches to the upper edge of a car window is provided. The flag support defining an angle of about 22.5 degrees before the flag support post and the window brace portion of the support. The angle, dimensions and reinforcement regions allow the flag support to be used with window visors which extend along the upper window edge of a vehicle window.

5 Claims, 5 Drawing Sheets

CAR WINDOW VISOR FLAG STICK

RELATED APPLICATIONS

This application claims the benefit of U.S. Application Ser. No. 61/961,804 filed on Oct. 24, 2013 and which is incorporated herein by reference.

FIELD OF THE INVENTION

This invention is directed to car flag supports that attach to an automobile window. Many car and truck windows have a sun/wind/rain visor which extends over the top of the window. Traditional car flags are often unable to be securely engaged to the window because the lack of clearance for the flag support caused by the dimensions by the visor.

BACKGROUND OF THE INVENTION

This invention relates to the Lalo U.S. Pat. No. 5,233,938 which discloses a vehicle flag system that includes a flag, a flag mast, and a window mount. However, the flag system does not teach or disclose an elongated flag support that is designed to accommodate window sun visors, and does not teach a flag support that can adjust the overall length in order to accommodate window sun visors of differing size.

The Spica U.S. Pat. No. 4,986,209 which is incorporated herein by reference, discloses an emergency distress signal, including a substantially "S" shaped channel member with one leg of the channel being insertable over the side glass of an automobile vehicle, to be entrapped between the side glass and the window channel, and the other leg of the "S" shaped channel member holding, in combination with a rod locator means, a collapsible flagstaff having an emergency distress flag attached thereto. However, the channel of the signal is not an elongated body that can accommodate window sun visors and yet provide a flag mast onto which a flag is supported.

The Hawes U.S. Pat. No. 3,715,821 which is incorporated herein by reference, discloses a sign assembly for use on a vehicle, which includes a bracket that would take the sign way from the window frame. Again, the sign assembly teaches a flag support of a fixed length, which is not adapted for use with window sun visors.

The Griffin U.S. Pat. No. 4,650,147 which is incorporated herein by reference, discloses a flagstaff for alternative uses that includes an elongated pole with fasteners for attaching a flag to the pole and a bracket for use in selectively attaching a flag to an automobile vehicle. Again, the flagstaff teaches a flag support of a fixed length, which is not adapted for use with window sun visors.

The Darago U.S. Pat. No. 5,226,792 which is incorporated herein by reference, discloses a distress flag for a vehicle with the flag being made of foldable material that uses magnetized weights affixed to edges of the distress flag to pull it down to properly display the message in use. However, the distress flag is not attached to a flag mast extending vertically from a flag support, which can accommodate and provide clearance around a window sun visor.

The Blalock U.S. Design Pat. No. 476,915 which is incorporated herein by reference, illustrates an ornamental design for a window-mountable flag and light, which does not teach or disclose a flag support that can provide clearance to a window sun visor via an elongated body.

Accordingly, there remains room for improvement and variation within the art.

SUMMARY OF THE INVENTION

It is one aspect of at least one of the present embodiments to provide for a window flag support for a motor vehicle comprising;

a support pole, the support pole have a rounded tip, a first reduced diameter segment formed bellowed the rounded tip, a plurality of barbs extending from a surface of the pole, barbs having a terminus defining a point, each point positioned in a downward facing direction;

a second reduced diameter segment positioned below the barbed surface portion of pole and above a circular support;

a clip member having a generally U-shaped configuration having a pair of opposing lips adapted when engaging an upper edge of a vehicle window and in communication with a window brace extending below the lips;

a base member attached to a bottom of a window brace and extending outwardly, the base member defined a narrowing taper at one end and which is in communication with the vertical upright;

a triangular support member extending from a surface of brace and continuous with an upper surface of the base member, the triangular support member further defining a gap between a terminal edge of support member and a lower edge of vertical upright;

a first brace and a second brace positioned on opposite sides of vertical upright, first brace extending along a bottom surface of base member, wherein, the pole and vertical upright being in axial alignment and positioned at a angle of substantially about 22.5 degrees relative to the window brace.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
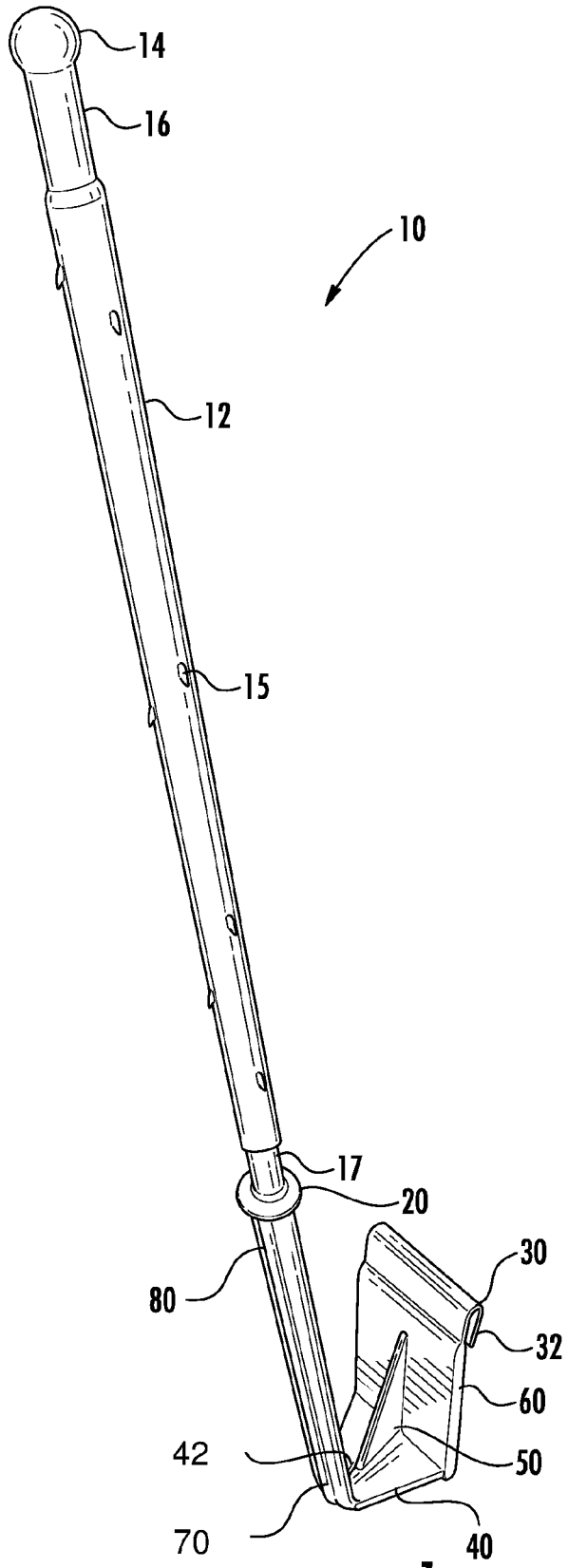
FIG. 1 is a perspective view of window flag support according to one exemplary embodiment.
Figure 2:
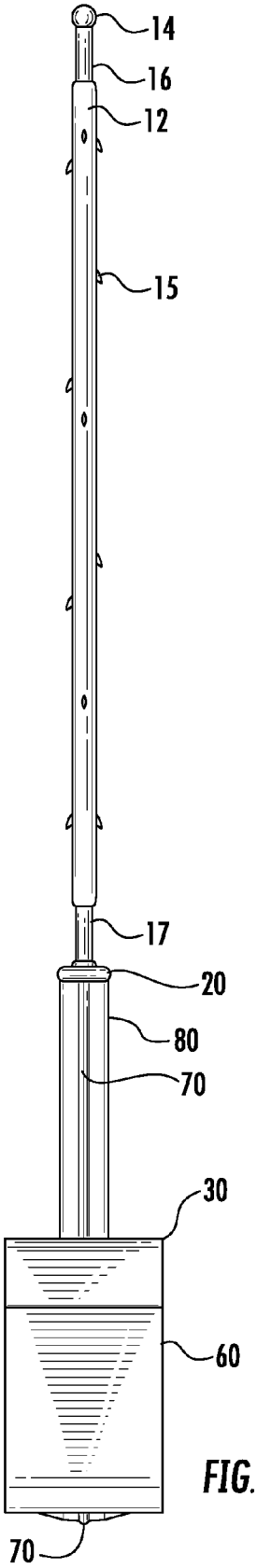
FIG. 2 is a front view of the flag support seen in FIG. 1.
Figure 3:
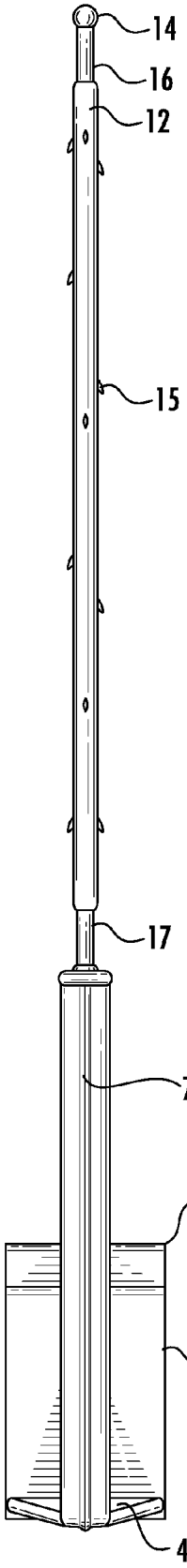
FIG. 3 is a rear view of the flag support seen in FIG. 1.

As seen in FIG. 1, a window flag support for a motor vehicle is set forth which includes a support pole 12, the support pole 12 having a rounded tip 14, a first reduced diameter segment 16 formed below the rounded tip 14, a plurality of barbs 15 extending from a surface of the pole 12, barbs 15 having a terminus defining a point, each point positioned in a downward facing direction relative to the orientation of FIG. 1. The barbs 15 allowing flag or banner to be lowered over the pole 12 and helps secure the flag pole once installed. The reduced diameter segment 16 provides a transition area between the round tip 14 and segment of the pole defining the barbs 15. This helps facilitate the insertion of the sleeve of the flag or the pole.

Figure 8:
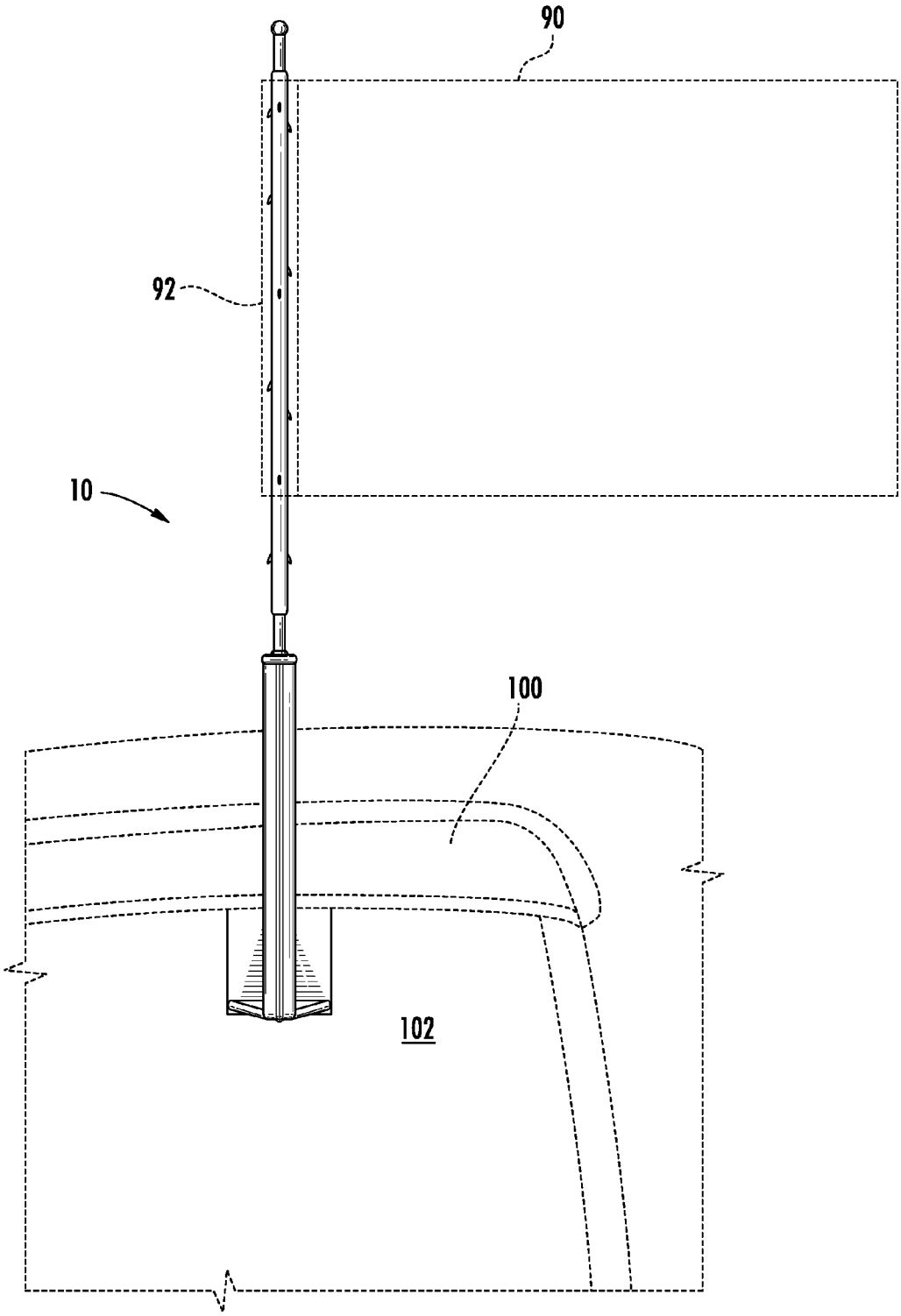
FIG. 8 is a back view of the flag support positioned on a car window.

A second reduced diameter segment 17 is positioned below the barbed surface portion of pole 12 and above a circular support 20. Circular support 20 secures the flag 90, as seen in FIG. 8, when installed by providing a lower stop member which engages and secures a lower sleeve of the flag. The lower sleeve 92 will not drop below the stop member provided by circular support 20. A clip member 30 having a generally U-shaped configuration defines a pair of opposing resilient lips 32 adapted to engage an upper edge of a vehicle window 102 (FIG. 8) and in communication with a window brace 60 extending below the lips 32.

A base member 40, seen best in FIGS. 2-5, is attached to a bottom of the window brace 60 and extends outwardly, the base member 40 defining a narrowing taper 52 at one end and which is in communication with the vertical upright 80. As best seen in comparison of the front and rear views of FIGS. 2 and 3 with the side views of FIGS. 4 and 5, the vertical upright portion 80 is wider from edge to edge than it is front a front to back depth. The side edges 74, one of which would be facing the moving air when positioned on a window, has a smaller profile than the front or rear edges. Accordingly, the smaller profile provides less wind resistance which allows for a product design that uses less material. Further, the edges 74 are slightly rounded to provide a better aerodynamic profile.

A triangular support member 50 extends from a surface of brace 60 and is supported along an upper surface of base member 40, the triangular support member 50 further defining a gap 42 between a terminal edge of support member 42 and a lower edge of vertical upright 80. The triangular shape of the support helps minimize wind resistant and noise when the vehicle is being driven. The support 50 provides additional strength to the U-shaped grip. The triangular sides of support 50 also minimize the side edge profile to minimize wind resistance. Gap 42 facilitates the passage of air and minimizes stress caused by the high velocity of movement of air when the vehicle is moving.

Figure 4:
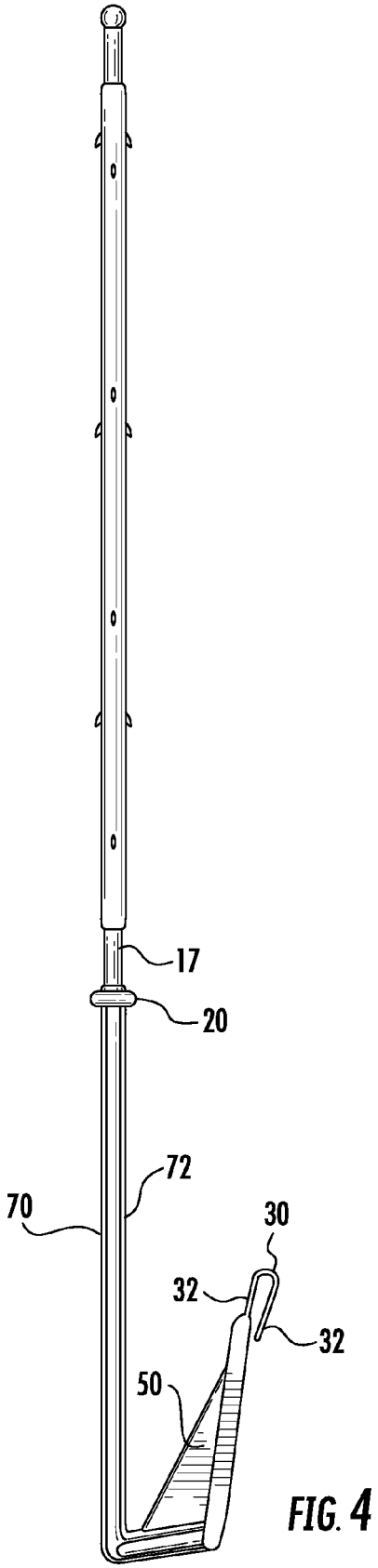
FIG. 4 is a left side view of the flag support as seen in FIG. 1.
Figure 5:
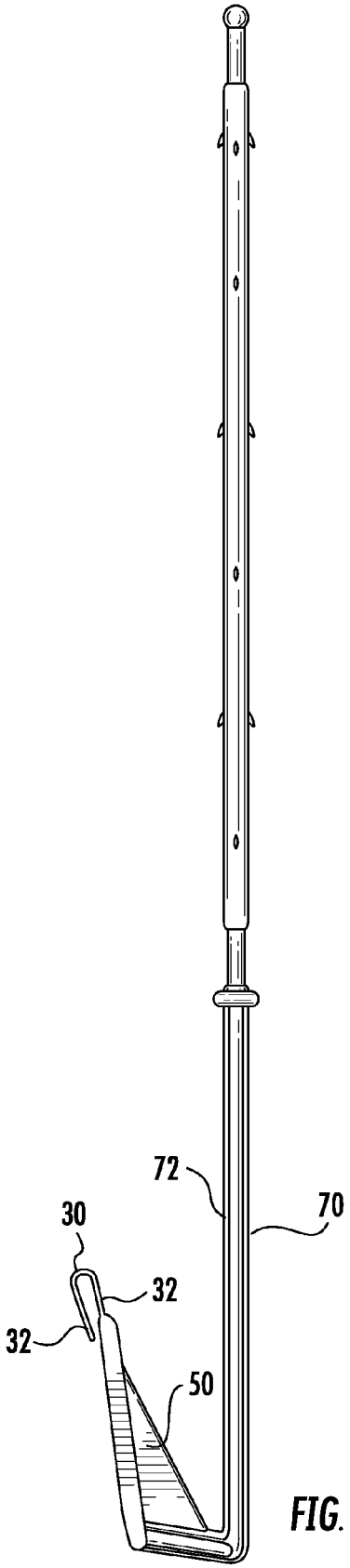
FIG. 5 is a right side view of the flag support as seen in FIG. 1.
Figure 6:
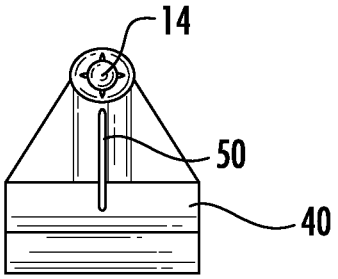
FIG. 6 is a top view of the flag support as seen in FIG. 1.
Figure 7:
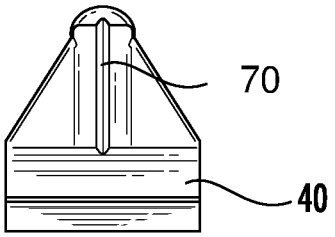
FIG. 7 is a bottom view of the flag support as seen in FIG. 1.

A first brace 70 and a second brace 72 are positioned on opposite sides of vertical upright 80, the first brace 70 extending also along a bottom surface of base 40, FIG. 7, wherein, the pole 12 and vertical upright 80 are in axial alignment and positioned at an angle of substantially about 22.5 degrees relative to the window brace. Braces 70 and 72 strengthen the vertical upright 80 and the axially aligned pole 12. Brace 72 extends along the top of base member 40 and engages a lower edge of support member 50 as seen in FIGS. 4 and 5. The 22.5 degree angle has been found useful to allow clearance with respect to the visor 100 as seen in FIG. 8.

Flag support 10 may be molded out of any suitable plastic material, including nylon and similar thermoplastic materials. If desired, an adhesive foam pad (not illustrated) can be used to provide a cushion between the window brace 60 and the vehicle window 102.

The design offers a flag holder that can be used with window visors, is lightweight, aerodynamic, and can withstand wind forces of carrying a flag at highway speeds. The lower wind resistance offers both reduced noise and allows the flag holder be constructed using less materials than normal in comparison to flag holders having a higher wind profile which, to obtain greater strength, uses increased materials.

With respect to the non-limiting example described above, the length of the flag holder 10 may be about 20.75 inches. The height of the clip and window brace is about 3.75 inches has a width of about 1⅝ inches. The diameter of the circular support 20 is about 0.75 inches.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. A window flag support for a motor vehicle comprising;

a support pole, the support pole having a rounded tip, a first reduced diameter segment formed bellow the rounded tip, a plurality of barbs extending from a surface of the pole, the barbs having a terminus defining a point, each point positioned in a downward facing direction;

a second reduced diameter segment positioned below the barbed surface portion of pole and above a circular support;

a clip member having a generally U-shaped configuration having a pair of opposing lips adapted for engaging an upper edge of a vehicle window and connected to a window brace extending below the lips;

a base member attached to a bottom of the window brace and extending outwardly, the base member defined a narrowing taper at one end and which is connected to the vertical upright;

a triangular support member extending from a surface of the base member and continuous with an upper surface of the base member, the triangular support member further defining a gap between a terminal edge of the support member and a lower edge of vertical upright;

a first brace and a second brace positioned on opposite sides of the vertical upright, the first brace further extending along a bottom surface of the base member, wherein, the pole and the vertical upright are in axial alignment and positioned at an angle of substantially about 22.5 degrees relative to the window brace.

2. The flag support according to claim 1 wherein the vertical upright has a width greater than a depth.

3. The flag support according to claim 1 wherein the second brace extends along a portion of the upper surface of the base member and further engages at least a portion of the triangular support member.

4. The flag support according to claim 1 wherein the second brace extends along an upper surface of the base member, the second brace further engages a lower edge of the triangular support member.

5. The flag support according to claim 1 wherein the support pole is secured to the vertical upright.

* * * * *